US009603199B2

(12) United States Patent
Wünning et al.

(10) Patent No.: US 9,603,199 B2
(45) Date of Patent: Mar. 21, 2017

(54) RADIANT HEATING ARRANGEMENT WITH DISTORTION COMPENSATION

(75) Inventors: Joachim A. Wünning, Leonberg (DE); Joachim G. Wünning, Leonberg (DE)

(73) Assignee: WS WÄRMEPROZESSTECHNIK GMBH, Rennigen (DE)

( * ) Notice: Subject to any disclaimer, the term of this patent is extended or adjusted under 35 U.S.C. 154(b) by 990 days.

(21) Appl. No.: 12/930,319

(22) Filed: Jan. 3, 2011

(65) Prior Publication Data

US 2011/0120453 A1 May 26, 2011

Related U.S. Application Data

(63) Continuation-in-part of application No. PCT/EP2009/004850, filed on Jul. 3, 2009.

(30) Foreign Application Priority Data

Jul. 4, 2008 (DE) ..... 20 2008 009 065 U

(51) Int. Cl.

| | |
|---|---|
| ***F24C 3/04*** | (2006.01) |
| ***H05B 3/64*** | (2006.01) |
| ***F23C 3/00*** | (2006.01) |
| ***F27D 99/00*** | (2010.01) |

(52) U.S. Cl.

CPC ..... *H05B 3/64* (2013.01); *F23C 3/002* (2013.01); *F27D 99/00* (2013.01); *F27D 99/0006* (2013.01); *F27D 99/0035* (2013.01); *F23C 2900/03009* (2013.01)

(58) Field of Classification Search

CPC ..... F23C 3/002; H05B 3/64

USPC ..... 126/91 A, 91 R; 219/430; 431/353, 159, 431/35 D

See application file for complete search history.

(56) References Cited

U.S. PATENT DOCUMENTS

| | | | | |
|---|---|---|---|---|
| 1,664,749 | A * | 4/1928 | Keene | F27D 3/18 432/52 |
| 2,632,503 | A * | 3/1953 | Bailey | 122/6.5 |
| 3,552,362 | A * | 1/1971 | Francis | 122/510 |
| 3,920,383 | A * | 11/1975 | Kerr | 432/223 |
| 4,338,076 | A * | 7/1982 | Straumann et al. | 431/351 |
| 4,520,789 | A * | 6/1985 | Rombouts | 126/91 A |
| 4,878,480 | A * | 11/1989 | Watson et al. | 126/91 A |

(Continued)

FOREIGN PATENT DOCUMENTS

| | | | |
|---|---|---|---|
| DE | 102007000746 | B3 * | 1/2009 |
| DE | 202012103366 | U1 * | 11/2012 |

(Continued)

OTHER PUBLICATIONS

JP 08278001 A Translation from Espacenet.*

*Primary Examiner* — Avinash Savani
*Assistant Examiner* — Aaron Heyamoto
(74) *Attorney, Agent, or Firm* — R. S. Lombard; K. Bach

(57) ABSTRACT

A radiant heat tube (5) comprises a tube body having a center section (6) and at least one recirculating section (7, 8) arranged next to the center section, said recirculating section forming a loop (9, 10) with said center section. A pivot joint bearing (23) is arranged on one end (12) of the radiant heat tube, while a sliding bearing (15) is arranged on the other end (11) of the radiant heat tube, said sliding bearing (15) being arranged opposite said pivot joint bearing (23). A burner (14) is disposed to heat the radiant heat tube (5).

20 Claims, 2 Drawing Sheets

(56) References Cited

U.S. PATENT DOCUMENTS

| | | | | | |
|---|---|---|---|---|---|
| 5,042,452 | A | * | 8/1991 | Dubreuil et al. | 126/91 A |
| 5,762,489 | A | * | 6/1998 | Wunning | 431/353 |
| 6,027,333 | A | * | 2/2000 | Fujii et al. | 431/215 |
| 6,047,929 | A | * | 4/2000 | Kaji et al. | 248/58 |
| 2004/0091830 | A1 | * | 5/2004 | Wunning et al. | 431/215 |
| 2010/0119983 | A1 | * | 5/2010 | Wunning et al. | 431/11 |
| 2010/0173072 | A1 | * | 7/2010 | Borrel | 427/248.1 |
| 2012/0200015 | A1 | * | 8/2012 | Ebner et al. | 266/249 |

FOREIGN PATENT DOCUMENTS

| | | | | |
|---|---|---|---|---|
| JP | 64-38415 | U | * | 3/1989 |
| JP | 05272708 | A | * | 10/1993 |
| JP | 07280477 | A | * | 10/1995 |
| JP | 08 278001 | A | | 10/1996 |
| JP | 08278001 | A | * | 10/1996 |
| JP | 08278002 | A | * | 10/1996 |
| JP | 09033014 | A | * | 2/1997 |
| JP | 09303713 | A | * | 11/1997 |
| JP | 2002317904 | A | * | 10/2002 |
| JP | 2002317905 | A | * | 10/2002 |
| JP | 2011196614 | A | * | 10/2011 |
| KR | 20100136417 | A | * | 12/2010 |
| WO | WO 2011044596 | A1 | * | 4/2011 |

* cited by examiner

RADIANT HEATING ARRANGEMENT WITH DISTORTION COMPENSATION

CROSS-REFERENCE TO RELATED APPLICATION

This is a continuation-in-part application of pending international application PCT/EP2009/004850 filed Jul. 3, 2009 and claiming the priority of German Application No. 20 2008 009 065.2 filed Jul. 4, 2008.

BACKGROUND OF THE INVENTION

The invention relates to a radiant heat tube that is also briefly referred to as a radiant tube.

Radiant heat tubes are used for heating furnace chambers, whereby said tubes are internally heated by a suitable heat source, for example, a burner, and heat up in doing so. Stock located in a furnace chamber is predominantly heated by thermal radiation emitted by the radiant heat tube.

In industrial applications, radiant heat tubes having several arms or branches are used, these having a considerable overall weight. One end of the radiant heat tube extends through a furnace wall. On the outside, a burner is usually attached by flanges. In order to absorb the considerable weight of the radiant heat tube said tube is frequently additionally supported on its opposite, closed end on the opposite furnace wall. In most instances, an appropriate support is mounted in a sliding bearing to enable the radiant heat tube to expand in longitudinal direction during operation.

It has been found that such sliding seats tend to jam occasionally and, in particular, when the radiant heat tube is very stiff. This is the case, e.g., in so-called double-P radiant tubes. This jamming may cause the radiant heat tube or its support to be damaged. Such damage can lead to gas leaks that are unacceptable.

Considering this, it is the object of the invention to offer a possibility to ensure the integrity of radiant heat tubes in a simple manner, in particular in view of their gas tightness.

SUMMARY OF THE INVENTION

A radiant heat tube (5) comprises a tube body having a center section (6) and at least one recirculating section (7, 8) arranged next to the center section, said recirculating section forming a loop (9, 10) with said center section. A pivot joint bearing (23) is arranged on one end (12) of the radiant heat tube, while a sliding bearing (15) is arranged on the other end (11) of the radiant heat tube, said sliding bearing (15) being arranged opposite said pivot joint bearing (23). A burner (14) is disposed to heat the radiant heat tube (5).

The radiant heat tube in accordance with the invention comprises a tube body having a center section that is preferably straight and two recirculating sections arranged next to said center section. Together with the center section, said recirculating sections form loops in which, e.g., a gas recirculation flow can form. Such radiant heat tubes have a large radiant surface. On the other hand, they are relatively stiff and heavy. Therefore, the radiant heat tube is preferably supported on both ends. On its one end, it is supported on a sliding bearing that is able to compensate for an axial expansion of the radiant heat tube. In addition, the sliding bearing enables a specific pivoting movement of the radiant heat tube. On its opposite end, the radiant heat tube is mounted on a pivot joint bearing that enables a pivoting movement of the radiant heat tube about at least one axis.

The pivot joint bearing preferably does not enable any axial movement of the radiant heat tube but fixes said radiant heat tube in position relative to axial direction.

The sliding bearing and the pivot joint bearing are preferably arranged on different, opposite furnace walls, between which the radiant heat tube is arranged and which support the radiant heat tube. In doing so, the support of the radiant heat tube is able to equalize thermally caused longitudinal changes of the radiant heat tube as well as relative movements of the furnace walls that are thermally caused or are due to ageing. In particular in the case of very large, long or high furnaces wherein a longer row of parallel radiant heat tubes heat a longitudinal furnace chamber, it is possible for the two furnace walls to potentially shift slightly parallel to each other, if necessary. The two bearings of the radiant heat tube that allow a specific pivoting movement essentially hold the radiant heat tube force-free and prevent the introduction of tensions in the radiant heat tube. Also, any lateral bending of the radiant heat tube may be compensated for if such bending should occur due to thermal or other reasons. This applies to ceramic radiant heat tubes and, in particular, also to radiant heat tubes of sheet steel.

Preferably, the pivot joint bearing defines a pivot axis extending transversely to the radiant heat tube. The pivot axis may be fixed off-center, e.g., at the edge of the radiant heat tube. Preferably, the associate pivot joint bearing is located outside the furnace chamber in the vicinity of the furnace wall. For example, said pivot joint bearing is positioned between the burner and the furnace wall.

The joint axis of the pivot bearing preferably extends in horizontal direction. As a result of this, the end of the radiant heat tube held in the sliding bearing may be slightly raised or lowered, without damaging forces acting on the radiant heat tube.

Furthermore, it is possible to configure the pivot joint bearing in such a manner that it is also possible for the radiant heat tube to slightly pivot in lateral direction. In doing so, said tube pivots about a vertical pivot axis. Consequently, any essential forces can be applied to the radiant heat tube without deformation of the furnace walls.

In the radiant heat tube according to the invention, the tube end on the burner-side end of the radiant heat tube is not immovably clamped in place. Rather, the radiant heat tube is mounted so as to be pivotable by a few degrees.

In the simplest case, the pivot joint bearing may be configured as a holder having a receptacle that is open toward the top, with a flange of the radiant heat tube being seated in said receptacle. The receptacle fixes the flange in vertical direction as well as in axial direction, however, allows a pivoting of the flange by a few degrees about a horizontal axis as well as about a vertical axis.

Preferably, a compensator is arranged between the end of the radiant heat tube supported by the pivot joint bearing and/or the flange and the furnace wall, said compensator sealing the furnace chamber with respect to the flange in a gas-tight manner, without immovably fixing the end of the radiant heat tube in place. It is also possible to mount the compensator to a radiant heat tube case, said case being seated in the furnace wall. The radiant heat tube case closes an opening provided in the furnace wall through which the radiant heat tube can be inserted into the furnace chamber. The compensator is, e.g., a corrugated, thin-walled sheet metal sleeve, whose one end is connected to the radiant tube and whose other end is connected to the furnace wall or an insert that is seated in an opening of the furnace wall. The compensator may be arranged on the outside of the furnace wall, i.e., outside the furnace chamber and, if necessary even inside said furnace chamber.

Additional details of advantageous embodiments of the invention are apparent from the drawings and the description. The description is restricted to essential aspects of the invention as well as miscellaneous situations. The drawings disclose additional details of the invention to be used for further reference.

DESCRIPTION OF A PARTICULAR EMBODIMENT

Figure 1:
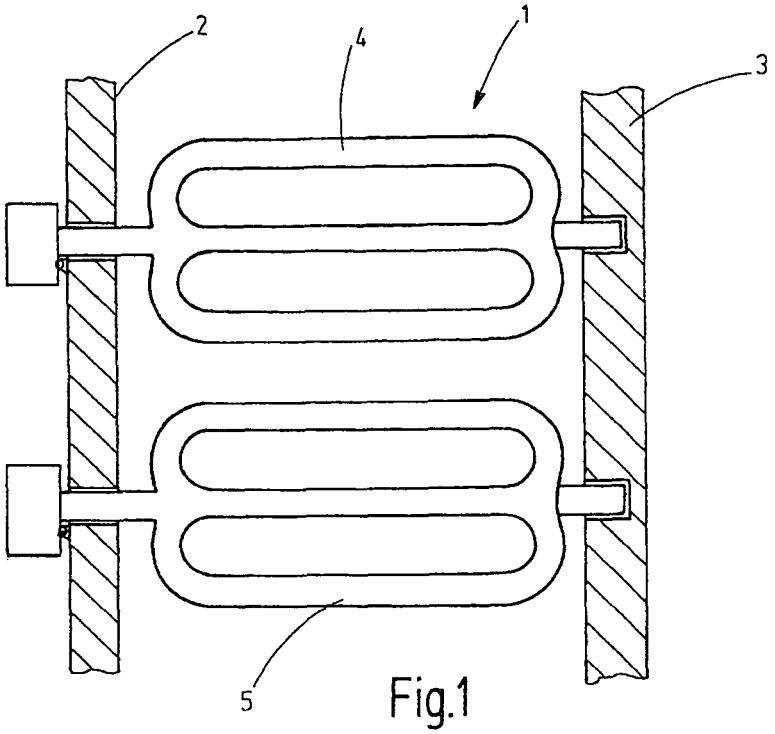
FIG. 1 is a schematic sectional representation of a furnace chamber comprising radiated heat tubes for heating said furnace space.

FIG. 1 shows a furnace chamber 1 that is delimited by two furnace chamber walls 2, 3. The furnace chamber 1 may be an elongated channel or tunnel, through which extend the radiant heat tubes 4, 5, each of said tubes preferably displaying the same relative transverse configuration and being arranged in a row. They are disposed to heat the furnace chamber as well as, in particular, appropriate stock to be treated, for example, a sheet metal web that is being passed in longitudinal direction through the furnace chamber.

Figure 2:
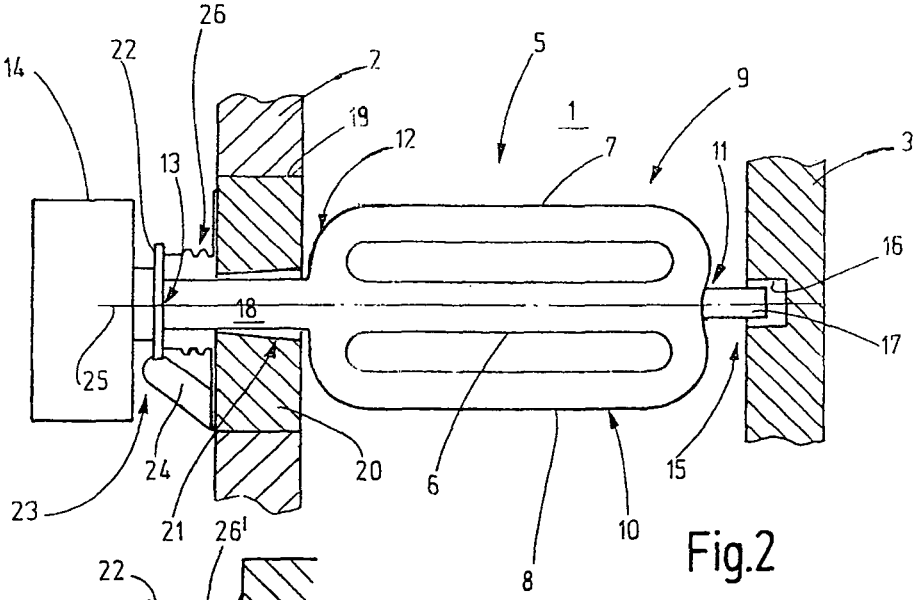
FIG. 2 is a separate schematic sectional representation of a radiant heat tube of the arrangement in accordance with FIG. 1.

As is obvious from the example of the radiant heat tube 5 in FIG. 2, the radiant heat tubes 4, 5 are supported on both furnace walls 2, 3. Preferably, said tube consists of sheet steel and has a tube-shaped, preferably straight, center section 6 and recirculating sections 7, 8 that form loops 9, 10 with the center section 6. Such radiant heat tubes 4, 5 are also referred to as "double-P radiant heat tubes". These tubes are closed on one end 11, while they are provided with an opening 13 on their other end 12, a burner 14 being connected to the end 12. The burner 14 supplies the inside space of the radiant heat tube 5 consisting, e.g., of sheet steel, with fuel and air and allows exhaust gases to leave the inside space of the radiated heat tube 5 to leave. Said burner 14 may be set up to maintain flameless oxidation or also to form a flame. The strong recirculating flow enabled by the double-P radiant heat tube facilitates the flameless operation and thus a uniform heating of the entire surface of the radiant heat tube 5.

The radiant heat tube 5 is supported on both ends 11, 12 and is largely not subject to any tension. The end 11 is mounted in a sliding bearing 15 to the furnace wall 3. In the simplest case, said sliding bearing is represented by an opening that is open toward the furnace chamber 1 and is provided in the furnace wall 3, whereby said opening may be lined, for example, with a bushing 16 or counter-bearing having a circular or oval or elongated cross-section. A pin 17 fits into this bushing 16, said pin being provided on the face-side, closed end 11 of the radiant heat tube 5. The pin 17 can be moved back and forth in longitudinal direction in the bushing 16. In addition, said pin has some play, so that it is also able to slightly pivot by at least fractions of one degree or more.

The other end 12 of the radiant heat tube 5 has a tube extension 18 extending through the furnace wall 2. This furnace wall has an opening 19 through which the radiant heat tube 5 may be inserted into the furnace chamber 1. The opening 19 is closed by a closure arrangement, for example, having the design of a so-called radiant heat tube case 20, said case forming a tight seal with the furnace wall 2. The radiant heat tube case 20 has a passage opening 21 through which extends the pipe extension 18.

Around its opening 13, the tube extension 18 is provided with a flange 22, for example, said flange having the form of a disk and extending in radial direction away from the edge of the tube extension 18. The flange 22 may be a round or polygonal disk and act as a support for the burner 14. In addition, said flange preferably represents half of a pivot joint bearing 23 by means of which the tube extension 18 and—with said tube extension—the radiant heat tube 5 are held so as to be pivotable. In order to enable at least moderate pivoting movements of the radiant heat tube 5, i.e., by a few degrees, the passage opening 21 is preferably slightly larger than the outside diameter of the tube extension 18.

The other half of the pivot joint bearing 23 is a support 24 that has a notch, groove or similar recess that is open toward the top, for example. The support is, e.g., made of thick steel sheeting that forms an upwardly extending arm with a recess on its upper free end. Seated in the recess is the lower edge of the flange 22 that is vertically aligned when in use. Consequently, the flange 22 abuts against the support 24 and is held in place relative to the axial direction, i.e., along a center axis 25. The center axis 25 is an imaginary center line that is concentric through the tube extension 18 and the center section 6. Due to this type of support, the flange 22, however, can pivot about a joint axis extending transversely to the center axis 25, said joint axis being perpendicular to the plane of projection of FIG. 2. It grazes the lower edge of the flange 22 and extends in horizontal direction when in use. Furthermore, if necessary, the flange 22 may slightly pivot about the vertical direction, said vertical direction potentially intersecting the center axis 25 and being parallel to the plane of projection in FIG. 2.

The support 24 or arm may also be forked and have two recesses at the top, each recess holding a section of the flange. As a result of this, the flange and, with it, the radiant tube can be pivoted about the horizontal axis. However, in this case, they cannot be pivoted about the vertical axis.

Figure 2A:
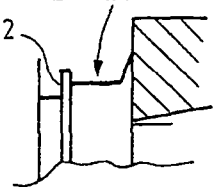
FIG. 2*a* is a modified embodiment of a compensator.

A compensator 26 may be provided in order to make the furnace gas-tight. For example, this compensator comprises a bellows arrangement in the form of a pleated metal bellows concentric to the tube extension 18, one edge of said bellows being connected with the flange 22 in a gas-tight manner and the other edge being held in a gas-tight manner on the radiant heat tube case 20. The compensator is elastic and preferably arranged outside the furnace chamber. The compensator 26 closes the channel formed by the passage opening 21 toward the outside in a gas-tight manner. FIG. 2*a* shows a modified compensator 26'. The compensator 26' is formed by a non-corrugated metal cuff on the end, said metal cuff being beaded in radially outward direction, i.e., being smooth on the outside.

Figure 3:
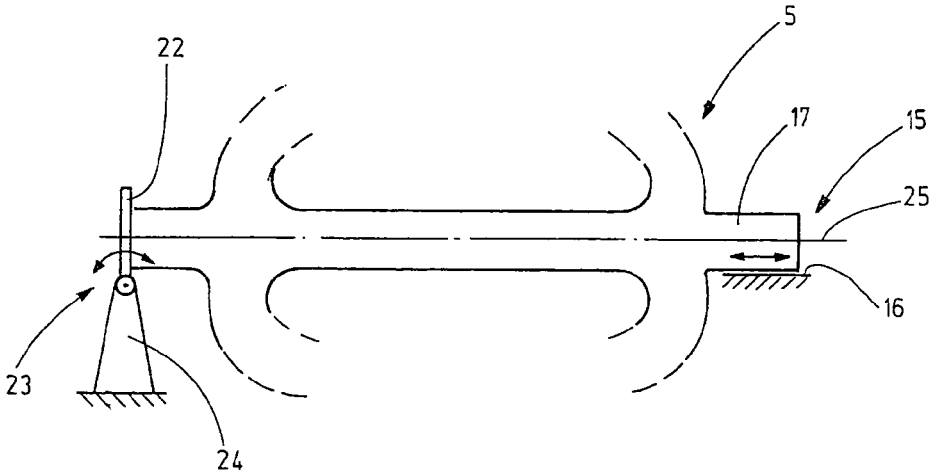
FIG. 3 is a schematic representation of the principle of supporting the radiant heat tube in accordance with FIG. 2; and, FIG. 4 is a schematic sectional representation of a modified embodiment of the invention.

The radiant heat tube 5 described so far is supported as illustrated in FIG. 3. The sliding bearing 15 enables movements along the center axis 25 and is thus disposed to compensate for the thermal expansion of the radiant heat tube 5 or also for the distance change between the furnace walls 2, 3 during the heating and cooling processes. In contrast, the pivot joint bearing 23 is disposed to compensate for a relative shift between the furnace walls 2, 3 parallel to each other. In doing so, forces are no longer applied to the radiant heat rube 5 when the furnace walls 2, 3 are being deformed. The pivot joint bearing 23 and the compensator 26 are preferably arranged in the cold zone, i.e., outside the furnace chamber 1, whereas the sliding bearing 15 may be arranged in the hot zone, i.e., in the furnace chamber.

Figure 4:
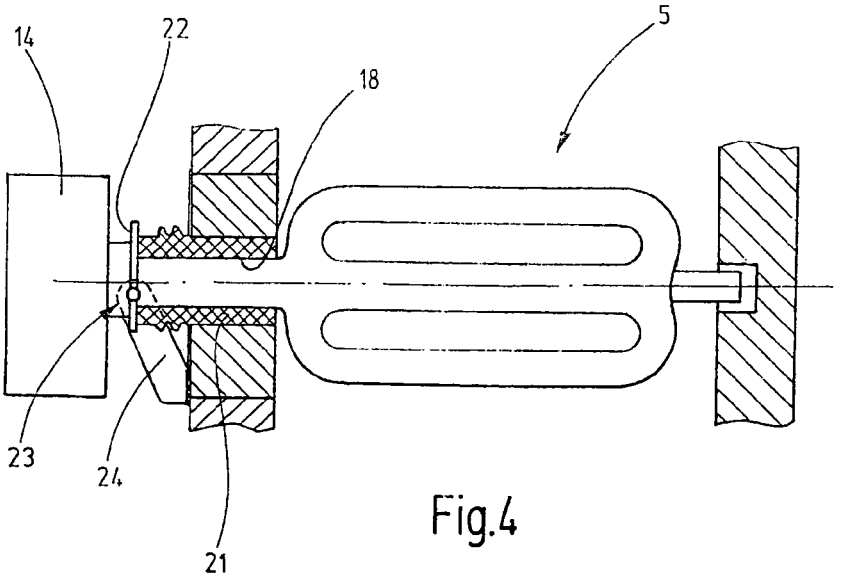

FIG. 4 shows an alternative embodiment of the radiant heat tube 5 in accordance with the invention. Using the same reference signs, reference is made to the previous description. However, the difference with respect to the latter is that the joint axis of the pivot joint bearing 23 is moved slightly toward the center axis 25. Consequently, said joint axis extends above the lower edge of the flange 22. Said flange may be provided, for example, with lateral pins that are received in one or more holders 24, e.g., an appropriate fork that holds the flange 22 on both sides.

In addition, the annular space formed between the passage opening 21 and the tube extension 18 may be filled with a resilient seal, for example, a sleeve of glass wool.

In summary, it should be stated that the invention relates, in particular, to double-P radiant heat tubes. Usually, the radiant heat tubes are laterally installed in the furnace wall and—with the use of a flange—tightly welded or screwed to the furnace wall. Usually, a counter-bearing affixed to the radiant heat tube is guided in a suitable support in the opposite side of the inside wall of the furnace. Usually, this support is configured in such a manner that the radiant heat tube may expand freely. When heated, said tube usually expands by a few centimeters. From the statistical viewpoint, this represents a fixed tension-mounting of the radiant heat tube to a sliding bearing located on one free end of said radiant heat tube. Damage may occur on the sliding bearing as well as on the radiant tube flange. This is the case, in particular in double-P radiant heat tubes because of the great stiffness of the radiant heat tube. Forces cannot always be absorbed by deforming the tube. Therefore, it is possible that weld seam ruptures will occur between the radiant heat tube flange and the radiant heat tube or between the radiant heat tube and the counter-bearing. The invention remedies this condition in that the fixed tension-mounting of the burner-side radiant heat tube end is replaced by a pivot joint bearing.

LIST OF REFERENCE SIGNS

1 Furnace chamber
2, 3 Furnace walls
4, 5 Radiant heat tube
6 Center section
7, 8 Recirculating sections
9, 10 Loops
11, 12 Ends
13 Opening
14 Burner
15 Sliding bearing
16 Bushing
17 Pin
18 Tube extension
19 Opening
20 Radiant heat tube case
21 Passage opening
22 Flange
23 Pivot joint bearing
24 Support
25 Center axis
26 Compensator

What is claimed is:

1. A radiant heat tube (5) for mounting in operative position substantially within a furnace chamber (1), the radiant heat tube (5) having a first outer end (12) and a second outer end (11) in opposite arrangement to each other extending between a pair of opposite furnace walls (2, 3) of the furnace chamber (1), the radiant heat tube (5) comprising a tube body having a straight center section (6) and at least one recirculating section (7, 8)) arranged next to the straight center section (6), said at least one recirculating section (7, 8) forming respectively at least one loop (9, 10) with the straight center section (6), a burner (14) for heating the radiant heat tube (5), and means for permitting a turning pivoting without enabling axial movement of the straight center section (6) of the radiant heat tube (5) for ensuring the integrity of the radiant heat tube (5);

wherein the means for permitting a turning pivoting without enabling axial movement of the radiant heat tube (5) for ensuring the integrity of the radiant heat tube (5) comprises a pivot joint bearing (23) including a flange burning connection (22) arranged on the first outer end (12) of the radiant heat tube (5), the pivot joint bearing (23) in operative arrangement with the straight center section (6) such that the flange burner connection (22) is held in place relative to an axial direction of the straight center section (6) of the radiant heat tube (5), a sliding bearing (15) in operative arrangement with the second outer end (11) of the radiant heat tube (5) opposite the pivot joint bearing (23), whereby the integrity of the radiant heat tube (5) is ensured by the turning pivoting without enabling axial movement of the straight center section (6) of the radiant heat tube (5).

2. The radiant heat tube of claim 1, wherein the tube body is closed on the second outer end (11), said second end including a pin (17) for operative engagement with the sliding bearing (15).

3. The radiant heat tube of claim 1, wherein the at least one recirculating section (7, 8) comprises two recirculating sections (7, 8), a first of said recirculating sections (7) forming a first loop (9) with the straight center section (6) and a second of said recirculating sections (8) forming a second loop (10) with the straight center section (6).

4. The radiant heat tube of claim 3, wherein the two recirculating sections (7, 8) each include a parallel portion extending parallel to the straight center section (6).

5. The radiant heat tube of claim 1, wherein the straight center section (6) and the at least one recirculating section (7, 8) consist of sheet steel or of cast steel.

6. The radiant heat tube of claim 1, wherein the pivot joint bearing (23) determines at least one pivot joint axis.

7. The radiant heat tube of claim 6, wherein the pivot joint bearing (23) determines a horizontally oriented pivot joint axis.

8. The radiant heat tube of claim 7, wherein the pivot joint axis does not intersect a center axis (25) of the straight center section (6) but extends transversely with respect to said center axis.

9. The radiant heat tube of claim 6, wherein the flange burner connection (22) being an upper part of the pivot joint bearing (23).

10. The radiant heat tube of claim 1, wherein the pivot joint bearing (23) is arranged outside the furnace chamber (1).

11. The radiant heat tube of claim 1, wherein the sliding bearing (15) includes a counter-bearing (16), the counter-bearing (16) is arranged on one of the opposite furnace walls (3) and the pivot joint bearing (23) is arranged on the other of the opposite furnace walls (2).

12. The radiant heat tube of claim 11, wherein the radiant heat tube (5) includes a tube extension (18) in coaxial alignment with the straight center section (6) extending through the other of the opposite furnace walls (2) so as to be movable in a pivoting manner, the pivot joint bearing (23) being arranged on the other of the opposite furnace walls (2).

13. The radiant heat tube of claim 12, wherein the tube extension (18) of the radiant heat tube (5) is gas-tight sealed with respect to the other of the opposite furnace walls (2) proximate the pivot joint bearing (23).

14. The radiant heat tube of claim 13, further including a compensator (26, 26') for gas-tight sealing the tube extension (18) to the other of the opposite furnace walls (2) proximate the pivot joint bearing (23).

15. The radiant heat tube as in claim 1, wherein the burner (14) is a burner set up for flameless oxidation.

16. The radiant heat tube of claim 12, wherein the other of the opposite furnace walls (2) includes an opening (19), the radiant heat tube (5) further includes a closure arrangement (20) having a passage opening (21) therethrough, the closure arrangement (20) for closing the opening (19) in a gas-tight sealing relationship, the tube extension (18) operatively passes through the passage opening (21).

17. The radiant heat tube of claim 16, wherein the passage opening (21) of the closure arrangement (20) is slightly larger than the outside diameter of the tube extension (18), whereby pivoting of the radiant heat tube (5) is permitted to a predetermined extent.

18. The radiant heat tube of claim 9, wherein the pivot joint bearing (23) further includes at least one bottom support (24), the at least one bottom support (24) supports the flange burner connection (22) in predetermined pivotal arrangement with respect to the at least one bottom support (24).

19. The radiant heat tube of claim 18, wherein the at least one pivot joint axis of the pivot joint bearing (23) is arranged below the flange burner connection (22).

20. The radiant heat tube of claim 18, wherein the at least one pivot joint axis of the pivot joint bearing (23) is arranged above a lower edge of the flange burner connection (22).

* * * * *